US007331621B2

(12) United States Patent
Johnson

(10) Patent No.: US 7,331,621 B2
(45) Date of Patent: Feb. 19, 2008

(54) DUMP BOX

(75) Inventor: Jeremy Johnson, Albertville, MN (US)

(73) Assignee: Alltech Manufacturing, LLC, Annandale, MN (US)

( * ) Notice: Subject to any disclaimer, the term of this patent is extended or adjusted under 35 U.S.C. 154(b) by 43 days.

(21) Appl. No.: 10/987,900

(22) Filed: Nov. 12, 2004

(65) Prior Publication Data

US 2006/0103152 A1 May 18, 2006

(51) Int. Cl.
*B66C 1/00* (2006.01)

(52) U.S. Cl. ..... 294/68.3; 294/68.26

(58) Field of Classification Search ..... 294/68.2, 294/68.21, 68.22, 68.26, 68.3, 82.24; 37/341, 37/398, 399
See application file for complete search history.

(56) References Cited

U.S. PATENT DOCUMENTS

| | | | | | |
|---|---|---|---|---|---|
| 540,116 | A | * | 5/1895 | Smith | 294/68.26 |
| 555,080 | A | * | 2/1896 | Delaney | 212/79 |
| 870,409 | A | * | 11/1907 | Baus | 294/68.26 |
| 916,331 | A | * | 3/1909 | Lance | 294/68.26 |
| 3,314,710 | A | * | 4/1967 | Edeburn | 294/68.26 |
| 3,918,758 | A | | 11/1975 | Fournier | 294/83 R |
| 3,998,487 | A | | 12/1976 | Biondo | 294/83 R |
| 4,251,099 | A | | 2/1981 | Hubalek et al. | 294/75 |
| 4,295,677 | A | * | 10/1981 | Petrin | 294/68.26 |
| 4,471,511 | A | | 9/1984 | Phipps | 24/241 |
| 4,536,024 | A | | 8/1985 | Gabriel | 294/82.24 |
| 4,647,095 | A | | 3/1987 | Gabriel | 294/82.24 |
| 4,765,667 | A | | 8/1988 | Hamrin | 294/82.33 |
| 5,205,600 | A | | 4/1993 | Moore | 294/82.27 |
| 5,292,165 | A | | 3/1994 | Wiklund | 294/82.33 |
| 6,272,775 | B1 | | 8/2001 | Schmidt et al. | 37/399 |

FOREIGN PATENT DOCUMENTS

| | | | | |
|---|---|---|---|---|
| AU | 403726 | * | 1/1967 | 294/68.26 |
| GB | 334604 | * | 9/1930 | 294/68.26 |
| GB | 547746 | * | 9/1942 | 294/68.26 |

* cited by examiner

*Primary Examiner*—Dean J Kramer
(74) *Attorney, Agent, or Firm*—Patterson, Thuente, Skaar & Christense, P.A.

(57) ABSTRACT

A dump box including a pair of opposing side walls joined to a bottom and a back; and a cable, including front ties, at least one front connector, at least one front cable, each front tie being sized and configured to selectively secure to the connector, the front cable being joined to the connector, the connector and front tie being secured when the front cable is taut and the connector and front tie being disengaged when the front cable is slack and a method of lowering material from an elevated location, including the steps of raising a dump box to an elevated location using cable joined to a crane; lowering the dump box onto the elevate location; placing material into the dump box; moving a connector to a front tie of the dump box; applying tension to the cable joining the dump box to the crane to secure the connector and front tie; raising the dump box off the elevated location; lowering the dump box onto a dumping location thereby releasing the connector from the front tie; and partially raising the dump box to pour out the contents.

4 Claims, 5 Drawing Sheets

DUMP BOX

FIELD OF THE INVENTION

The present invention relates to refuse containers and more specifically to refuse containers used for hauling debris from on top of tall office buildings to containers located on the ground.

BACKGROUND OF THE INVENTION

The construction industry perhaps started from simple homes and later developed to tall buildings, often referred to as sky scrapers. During construction many portions of building materials are discarded as the pieces are cut, torn, pulled or otherwise removed from the usable portion of the building material. In buildings close to the ground, such waste can be tossed over the edge and allowed to fall into a ground level dumpster or the ground. As the number of levels are added to the building, such practice is downright dangerous.

Multi-storied building may have an onsite crane that raises and lowers materials. Refuse removal typically involves use of a four-sided dumpster. A crane operator raises and lowers the dump box between the appropriate floor and the ground. Another construction worker on the ground through manual maneuvers, assists in emptying the dump box. The back of the dump box may be raised to poor out the contents. A third construction worker may be placed on top of the building to move the refuse into the dump box and the process continues.

One can understand that dumping the garbage does in fact take three people under the current practices. The present system is highly wasteful given the wages of construction workers and the enormous downtime between loads. What is needed is a dump box and method of operation that avoids the services of the construction worker located on the ground. The front end of the dump box should disengage from the cables at the behest and timing of the crane operator. Further, the front of the dump box should engage the cables at the control of the construction worker loading the refuse. Such a system allows the construction worker on the ground to perform more valuable services elsewhere on the job site.

SUMMARY OF THE INVENTION

The present inventive dump box changes a three person job into a two person job eliminating the need for the construction worker on the ground. The front end of the dump box disengages at the determination of the crane operator. Then after a slight lifting of the back of the dump box empties the contents, which may also be performed from within the crane. The construction worker atop the building structure can re-engage the front of the dump box with the cables, while loading refuse.

For instance, the dump box may include a pair of opposing side walls joined to a bottom and a back; and a cable mechanism. The cable mechanism may include front ties, at least one front connector, and at least one front cable. Each front tie is desirably sized and configured to selectively secure to the front connector. The front cable can be joined to the front connector. The front connector and front tie are secure when the front cable is taut and the front connector and front tie may disengage when the front cable is slack. That is, when the crane operator, in control of the cable, sets the dump box on the ground, the front connector, joined to the cable, disengages from the front tie.

Specifically in operation, lowering material from an elevated location may include the steps of raising a dump box to an elevated location using cable joined to a crane; lowering the dump box onto the elevated location; placing material into the dump box; moving a connector to a front tie of the dump box; applying tension to the cable joining the dump box to the crane to secure the connector and front tie; raising the dump box off the elevated location; lowering the dump box onto a dumping location thereby releasing the connector from the front tie; and partially raising the dump box to pour out the contents.

Advantageously, the present invention avoids the need for a third construction worker on the ground to safely remove refuse from an elevated location.

As yet a further advantage, the present invention is simple in construction and operation.

Also as an advantage, the dump box weighs substantially less than prior boxes due to the three-sided construction.

These and other advantages will become clear from reading the detailed description with reference to the drawings.

DETAILED DESCRIPTION

Figure 1:
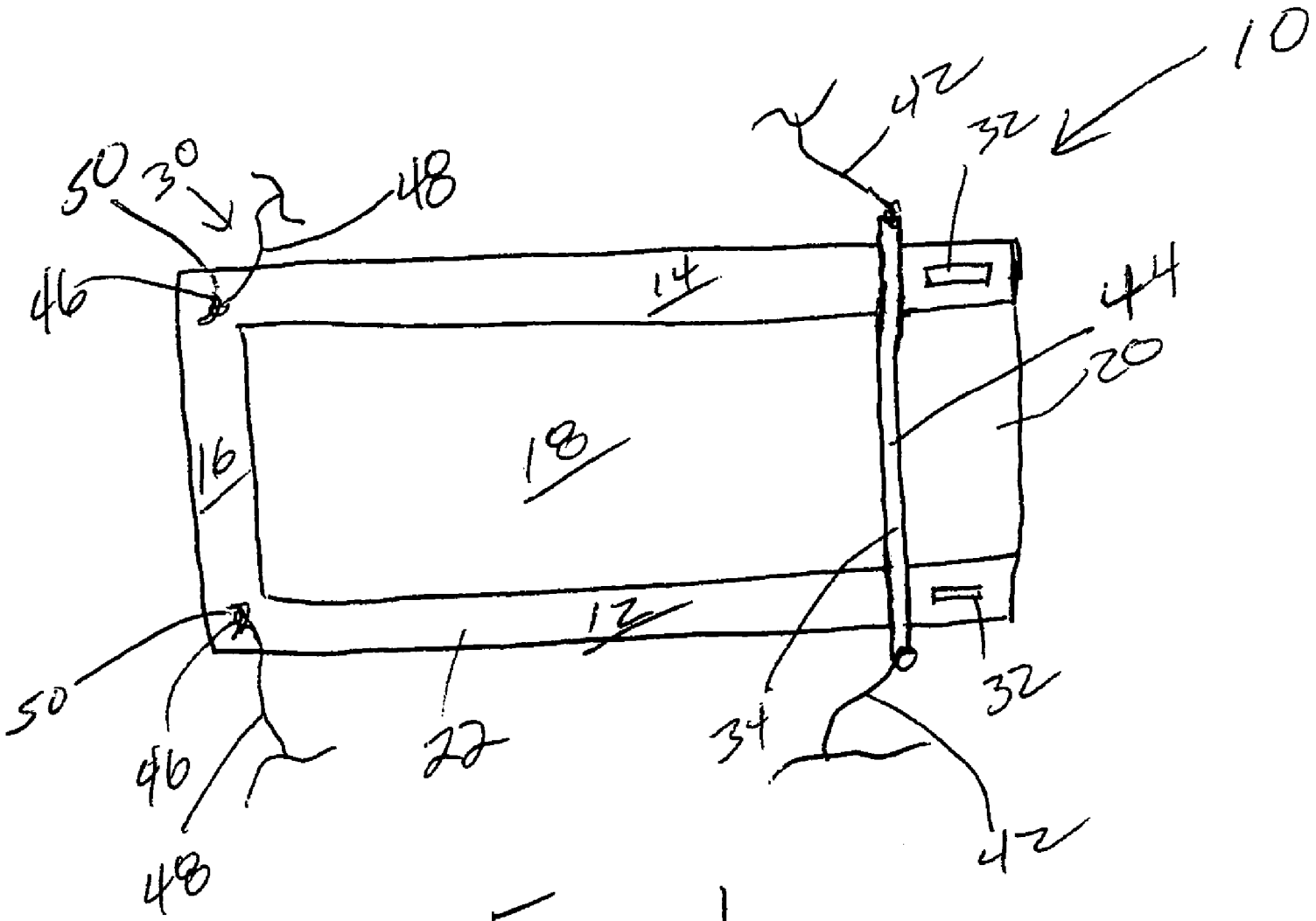
FIG. 1 is top view of the dump box of the present invention.

The present invention is a dump box 10 designed with a cable mechanism 30. The dump box 10 may be used to remove waste from elevated locations, such as atop a building. The box 10 may be dumped without a man on the ground being needed to disengage all or a part of the dump box 10 from the crane to permit the dumping. The best mode of making and using the box 10 and cable mechanism 30 are discussed below.

The box 10 may have a right side 12, a left side 14, a back 16 and a bottom 18. As such this is a three sided container with the fourth wall missing, e.g. open end 20. An upper edge 22 may be cooperatively defined by the right side 12, left side 14 and back 16. The right and left side 12, 14 join to the back 16 and bottom 18 to form the three-sided box. In this configuration, the dump box 10, when being lowered with refuse therein may be tilted, i.e. the back wall 16 and bottom wall 18 are positioned similar to a V-shape to better contain the refuse. The open end 20 is used for an exit for dumping the refuse. Suitable materials for constructing the box are those materials customarily used in the field, perhaps being ¼" thick aluminum.

The cable mechanism 30 may include front ties 32, front cable 42, back ties 46 and back cable 48. The front cable 42 and back cable 48 do not necessarily need to be separate cables but merely that the cable joins to or adjacent the open end 20 and back 16 of the dump box 10. That is, the front cables 42 may be contiguous with each other and or contiguous with the back cables 48. The cables 42 and 48 may join to a crane used for raising and lowering the box 10 from and elevated location such as the top of a building. The front cable 42 may be joined to a connector 34, preferably a bar 44, while the back cable 48 may be fixedly joined to the box 10. A vertical cable 60 may join to the font cable 42 and to the back cable 48 with the vertical cable 60 adapted to be joined to a crane.

Figure 2:
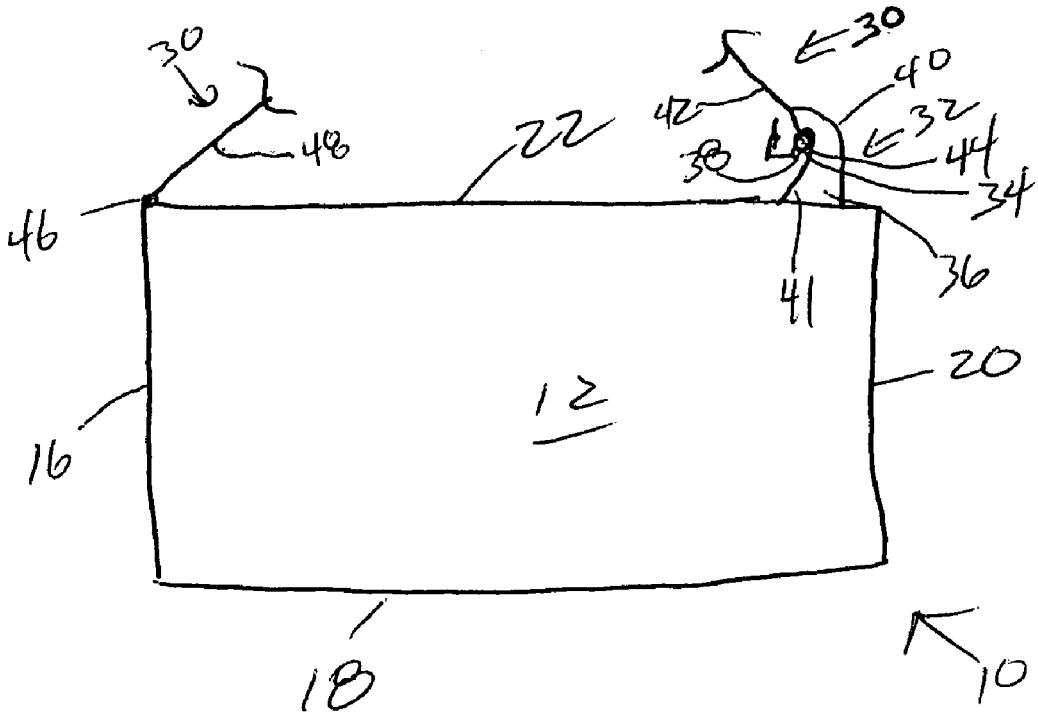
FIG. 2 is a side view of the dump box of the present invention.
Figure 3:
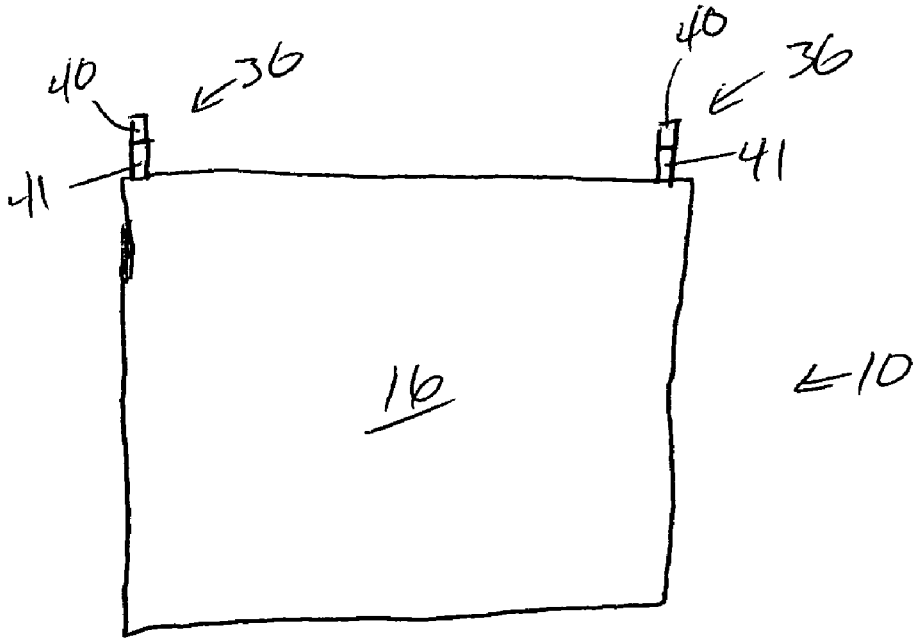
FIG. 3 is a back end view of the dump box of the present invention.
Figure 4:
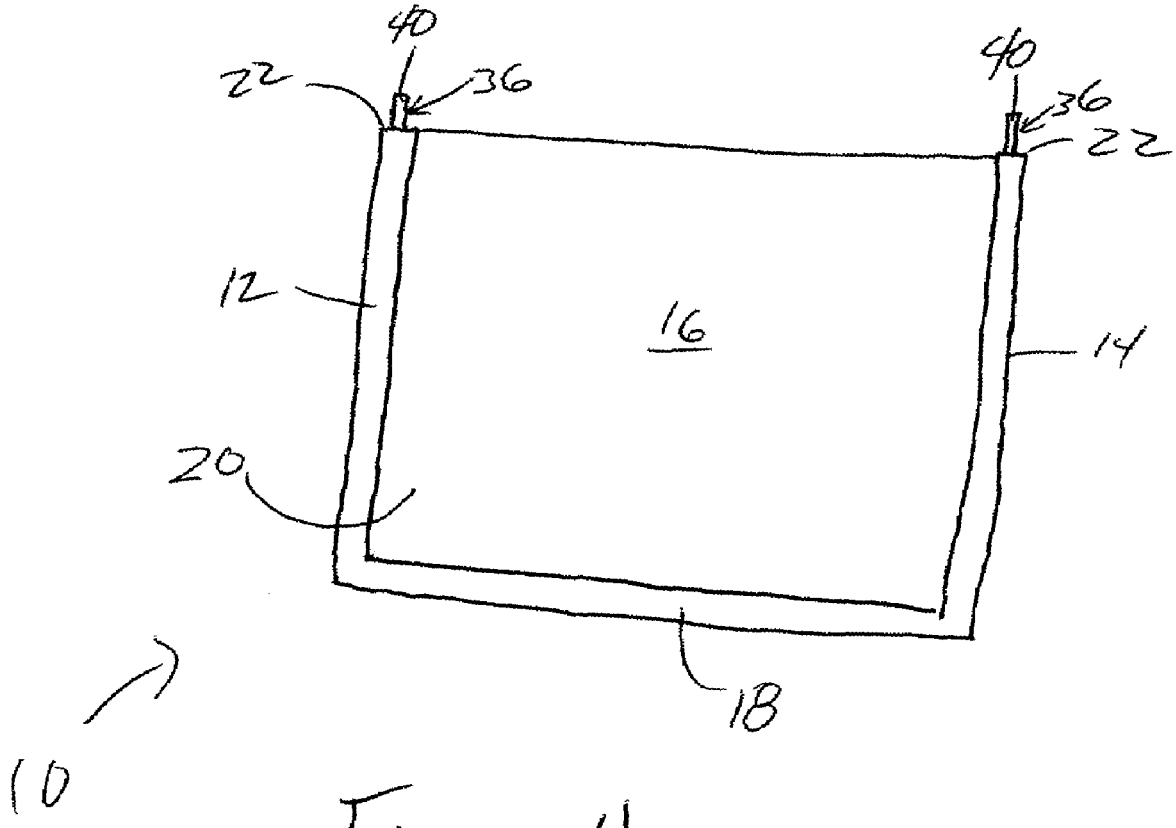
FIG. 4 is a front end view of the dump box of the present invention.
Figure 6:
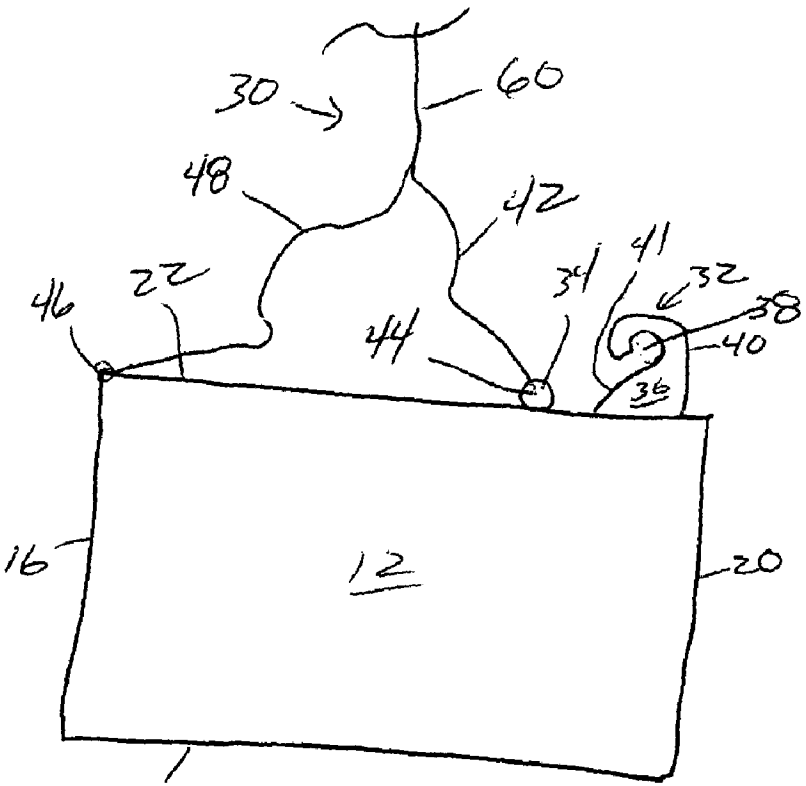
FIG. 6 is a right side view (and mirror of left side view) of the dump box of the present invention with tension released from the cables.
Figure 5:
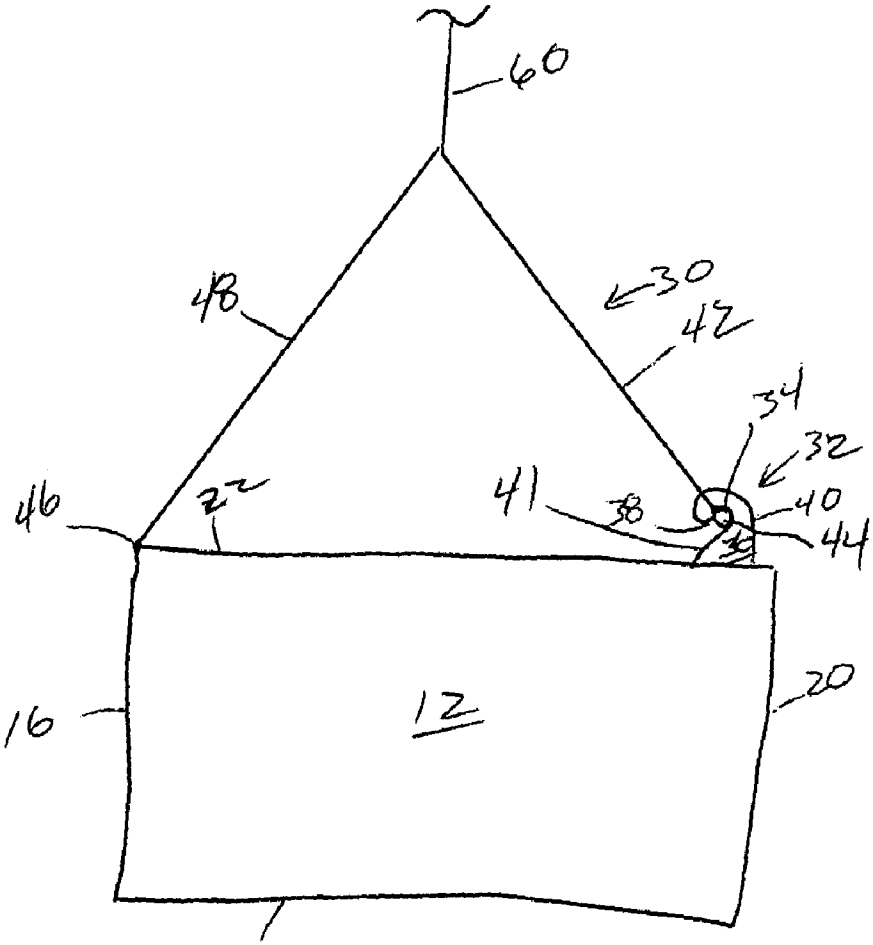
FIG. 5 is a right side view (and mirror of left side view) of the dump box of the present invention with the cable taut.
Figure 7:
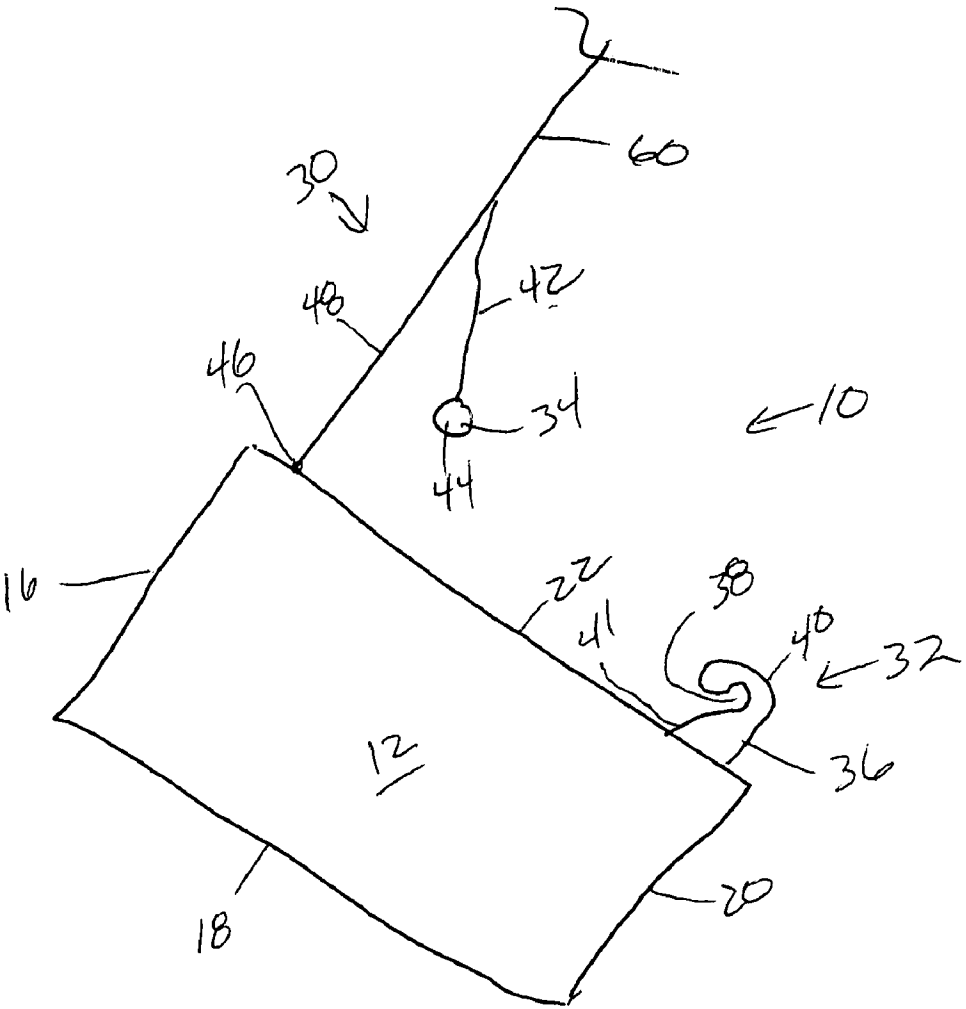
FIG. 7 is a right side view (and mirror of left side view) of the dump box of the present invention with the cable made taut and raised after the tension has been released as shown in FIG. 6.

Front ties 46 may include at least one hook 36 secured to the upper edge 22. The hook 36 desirably releases from the front cable 42 when the box 10 is set upon the ground. The hook 36 preferably has an edge 40 defining a slot 38. The edge 40, directly below the slot 38, tapers rearward and downwardly toward the upper edge 22 of the box 10 to which the hook 36 is joined as shown in FIG. 2. The slot 38 is sized to selectively secure the connector 34, which may be a bar 44, and the taper of the edge 40 is designed to direct the bar 44 away from the slot when tension is released on the front cable 42. The connector 34 and hooks 36 are adapted to disengage by releasing tension on the front cable 42. A lower portion of the taper 41 may be terminate more rearwardly than the slot 38. Greater explanation of the operation is provided below.

The back tie 46 may be any mechanism 50, such as welding, fastener, or fixture, for fixing the back cable 48 to the upper edge 22 on or adjacent the back 16. The back tie 46 and back cable 48 may be permanently fixed to the box 10.

The present invention also include a method of lowering material from an elevated location. First, a dump box 10 may be raised to an elevated location using cable 60 joined to a crane. The dump box 10 may be lowered onto the elevated location with or without releasing tension on the front cable 42. Material may be placed into the dump box 10. If tension was released, a connector 34 may be moved to a hook 36 on the dump box 10. Tension may be reapplied to the cable 60 joining the dump box 10 to the crane to secure the connector 34 and hook 36. Then, the loaded dump box 10 is raised off the elevated location and lowered onto a dumping location, perhaps the ground thereby releasing the connector 34 from the hook 36. Partially raising the dump box 10 pours out the contents.

Once dumped, the emptied dump box 10 may be raised to the elevated location without joining the connector 34 to the hook 36. As such all manual operations are performed inside the crane and on the elevated location. Gravity disengages the connector 34 from the hook 36 when the tension is released from the front cable 42.

Although the present invention has been described with reference to preferred embodiments, workers skilled in the art will recognize changes may be made in form and detail without departing from the spirit and scope of the invention.

The invention claimed is:

1. A method of lowering material from an elevated location, comprising the steps of:

raising a dump box to an elevated location using cable joined to a crane;

lowering the dump box onto the elevated location;

placing material into the dump box;

moving a bar to a front tie of the dump box;

applying tension to the cable joining the dump box to the crane to secure the bar and front tie;

raising the dump box off the elevated location;

lowering the dump box onto a dumping location thereby releasing the bar from the front tie; and partially raising the dump box to pour out the contents.

2. The method of claim 1 further comprising the step of lifting the emptied dump box to the elevated location.

3. The method of claim 1 wherein all manual operations are performed inside the crane and on the elevated location.

4. The method of claim 1 wherein gravity disengages the bar from the front tie.

* * * * *